US005305572A

United States Patent [19]

Yee

[11] Patent Number: 5,305,572

[45] Date of Patent: Apr. 26, 1994

[54] LONG SPAN POST-TENSIONED STEEL/CONCRETE TRUSS AND METHOD OF MAKING SAME

[76] Inventor: Alfred A. Yee, 1441 Kapiolani Blvd., Honolulu, Hi. 96814

[21] Appl. No.: 708,712

[22] Filed: May 31, 1991

[51] Int. Cl.[5] ..... E04C 3/10; B28B 5/00

[52] U.S. Cl. ..... 52/223.8; 264/35; 264/228; 52/643; 52/690

[58] Field of Search ..... 52/223 R, 639-644, 52/690, 223 L, 174, 230; 264/35, 228

[56] References Cited

U.S. PATENT DOCUMENTS

| | | | |
|---|---|---|---|
| 128,349 | 6/1872 | Zellweger | 14/6 |
| 995,437 | 6/1911 | Casanova | 52/690 |
| 1,153,411 | 9/1915 | Wuczkowski | 52/653 |
| 1,412,096 | 4/1922 | Von Emperger | 52/225 |
| 2,151,267 | 3/1939 | Finsterwalder | 52/690 |
| 2,685,194 | 8/1954 | Amirikian | 52/229 |
| 2,712,750 | 7/1955 | Finsterwalder | 52/223 R |
| 2,898,757 | 8/1959 | Finsterwalder | 52/223 R |

FOREIGN PATENT DOCUMENTS

| | | | |
|---|---|---|---|
| 550108 | 12/1922 | France | 52/634 |
| 1387437 | 1/1964 | France | 14/6 |
| 301716 | 10/1942 | Switzerland | 52/223 R |
| 740121 | 11/1955 | United Kingdom | 52/223 L |

*Primary Examiner*—James L. Ridgill, Jr.
*Attorney, Agent, or Firm*—Jacobson, Price, Holman & Stern

[57] ABSTRACT

A long span truss of substantially conventional steel construction provided with concrete encasement of the top and bottom chords with the concrete encasement being reinforced and the concrete encasement on the bottom chord and optionally on the top cord including post-tensioned steel tendons. The invention further relates to a method of making the truss as described above in which the light structural steel truss is first erected and provided with temporary steel scaffolding and bracing to support formwork. Reinforcing steel and steel tendons are placed in the formwork and concrete is poured to encase the top and bottom chords of the truss. The steel tendons are post-tensioned to provide maximum load support capability. The truss of the present invention can be used in situation where trusses are used to carry heavy loads over long spans such as bridges, stadiums, convention halls and the like and is especially beneficial when spanning a busy highway or waterway with the trusses including a single span or continuous trusses of two or more spans in which one or more intermediate supports are employed.

5 Claims, 2 Drawing Sheets

LONG SPAN POST-TENSIONED STEEL/CONCRETE TRUSS AND METHOD OF MAKING SAME

BACKGROUND OF THE INVENTION

1. FIELD OF THE INVENTION

The present invention generally relates to a long span truss of substantially conventional steel construction provided with concrete encasement of the top and bottom chords with the concrete encasement being reinforced and the concrete encasement on the bottom chord and optionally on the top chord including post-tensioned steel tendons. The invention further relates to a method of making the truss as described above in which the light structural steel truss is first erected and provided with temporary steel scaffolding and bracing to support formwork. Reinforcing steel and steel tendons are placed in the formwork and concrete is poured to encase the top and bottom chords of the truss. The steel tendons are post-tensioned to provide maximum load support capability. The truss of the present invention can be used in situation where trusses are used to carry heavy loads over long spans such as bridges, stadiums, convention halls and the like and is especially beneficial when spanning a busy highway or waterway with the trusses including a single span or continuous trusses of two or more spans in which one or more intermediate supports are employed.

2. DESCRIPTION OF THE PRIOR ART

Trusses of various configurations and arrangements have been utilized in structures and usually include a top chord and a bottom chord interconnected by vertical and diagonal brace members rigidly connected together with the ends of the truss being supported which introduces tension forces to the bottom chord and compression forces to the top chord. In other instances, a continuous truss is supported at intermediate points as well as at the ends thus introducing tension forces to the top chord as well a the bottom chord depending upon the relationship between the truss and the support points. It is well known to encase or clad components of the truss in concrete for increasing the strength of the truss, insulation, fireproofing and other well known purposes. Prior truss structures do not include the concept of encasing the top and bottom chords in concrete after the truss has been erected with the truss being constructed of relatively lightweight steel which supports formwork to pour the concrete to encase the top and bottom chords of the truss with the bottom chord and optionally the top chord including steel tendons that are post-tensioned to obtain maximum load supporting characteristics for the truss.

SUMMARY OF THE INVENTION

An object of the present invention is to provide a long span truss constructed of steel with reinforced concrete encasement of the top and bottom chords with the bottom chord and optionally the top chord and bottom chord being provided with steel tendons which are post-tensioned to provide optimum support capability to the truss.

Another object of the invention is to provide a method of making a long spa truss in which the relatively lightweight steel truss is first erected and formwork is supported therefrom to enable concrete to be poured to encase the top and bottom chords of the truss with steel tendons being arranged in the formwork together with reinforcement materials being arranged in the formwork prior to pouring concrete to reinforce and strengthen the truss with the reinforced concrete having the steel tendons positioned therein being post-tensioned by using conventional post-tensioning techniques thereby materially increasing the strength and rigidity of the truss.

A further object of the invention is to provide a truss and method in accordance with the preceding objects in which only the bottom chord is provided with post-tensionable steel tendons in a truss that is supported only at its opposite ends with both the bottom chord and top chord being provided with post-tensionable steel tendons when the truss is in the form of a continuous truss with intermediate as well as end supports.

Still another object of the present invention is to provide a long span truss and method of making the same in which the truss is constructed of a steel frame having the top and bottom chords thereof encased in concrete with the bottom chord and optionally the top chord being provided with post-tensionable steel tendons which can be post-tensioned to provide maximum load support capabilities to the truss with the truss being especially useful when used as a long span truss in the construction of bridges, stadiums, conventions halls and other structures in which a long span truss would be beneficial.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
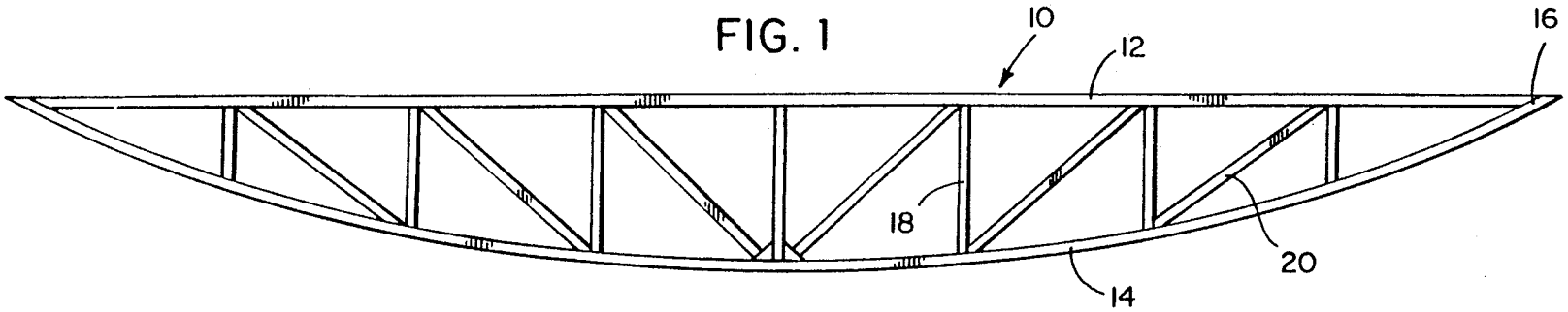
FIG. 1 is a schematic elevational view illustrating a basic truss structure of lightweight steel having a curved bottom chord and a straight top chord interconnected by vertical and diagonal bracing.

Referring now to the drawings, FIG. 1 illustrates a conventional truss 10 and depicts the first step in the method of forming the long span, post-tensioned steel/-concrete truss of the present invention. The truss 10 is of conventional construction and includes a top chord 12, a bottom chord 14 rigidly connected at their ends at 16 and provided with vertical bracing 18 and diagonal bracing 20. The components of the truss 10 are relatively lightweight steel I-beams or other suitable shapes with the components being rigidly interconnected as by using various fastening means such as bolts or welding. The length of the truss 10 as well as the specific configuration may be varied. For example, the top and bottom chords 12 and 14 may be straight, curved or angled depending upon the installational requirements.

Figure 2:
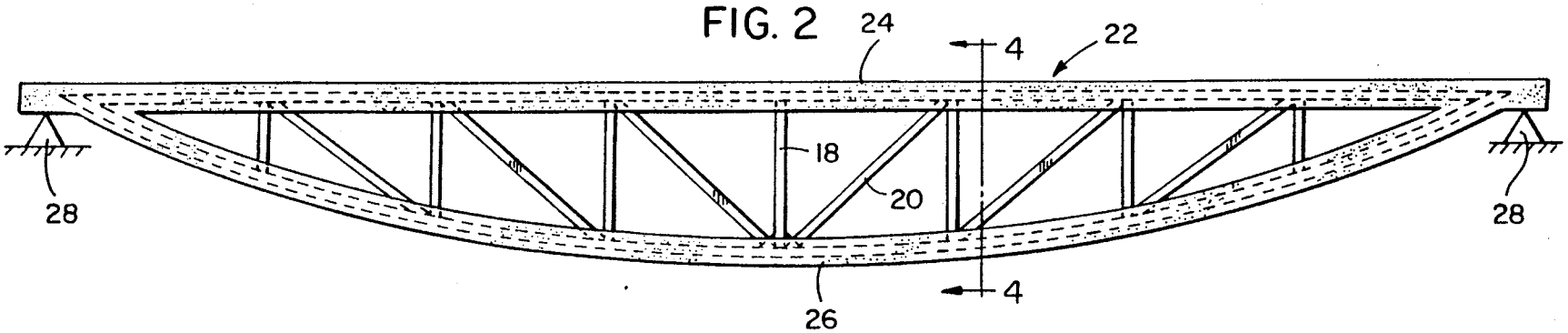
FIG. 2 is a view similar to FIG. 1 illustrating the top and bottom chords encased in concrete with the ends of the truss being supported by support structures.

FIG. 2 illustrates a truss 22 which has been constructed in accordance with the present invention with the truss 22 being the same as the truss 10 except that the top chord 12 is now encased in concrete 24 and likewise, the bottom chord is also encased in concrete 26 and schematic load supports 28 are supportingly engaged with the outer ends of the truss.

Figure 3:
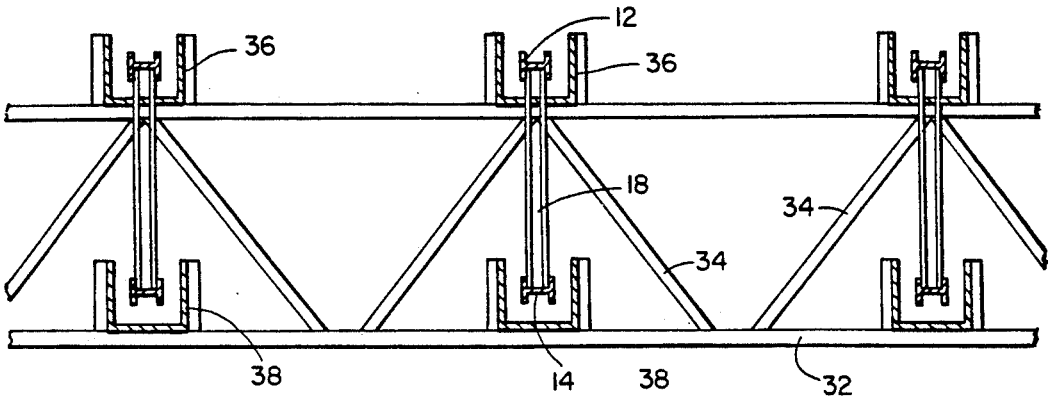
FIG. 3 is a transverse sectional view of a plurality of trusses illustrating formwork supported in relation thereto by scaffolding connected to the trusses by brace members.

FIG. 3 is a view illustrating several parallel trusses in spaced relation with the trusses being shown in transverse section. Attached to the trusses 10 is scaffolding 30 spaced below the upper chord 12 and scaffolding 32 spaced below the lower chord 14 with the scaffolding being supported by bracing 34 connected to the braces 18 and 20 of the trusses 10 or connected to the trusses in any other suitable manner to effectively support the scaffolding 30 and 32. The scaffolding 30 supports formwork 36 for the upper chord 12 and the scaffolding 32 supports formwork 38 for the lower chord 14 with the formwork 36 and 38 being schematically illustrated as open-topped U-shaped forms in which concrete 24 and 26 can be poured so that it encases the top chord 12 and bottom chord 14.

Figure 4:
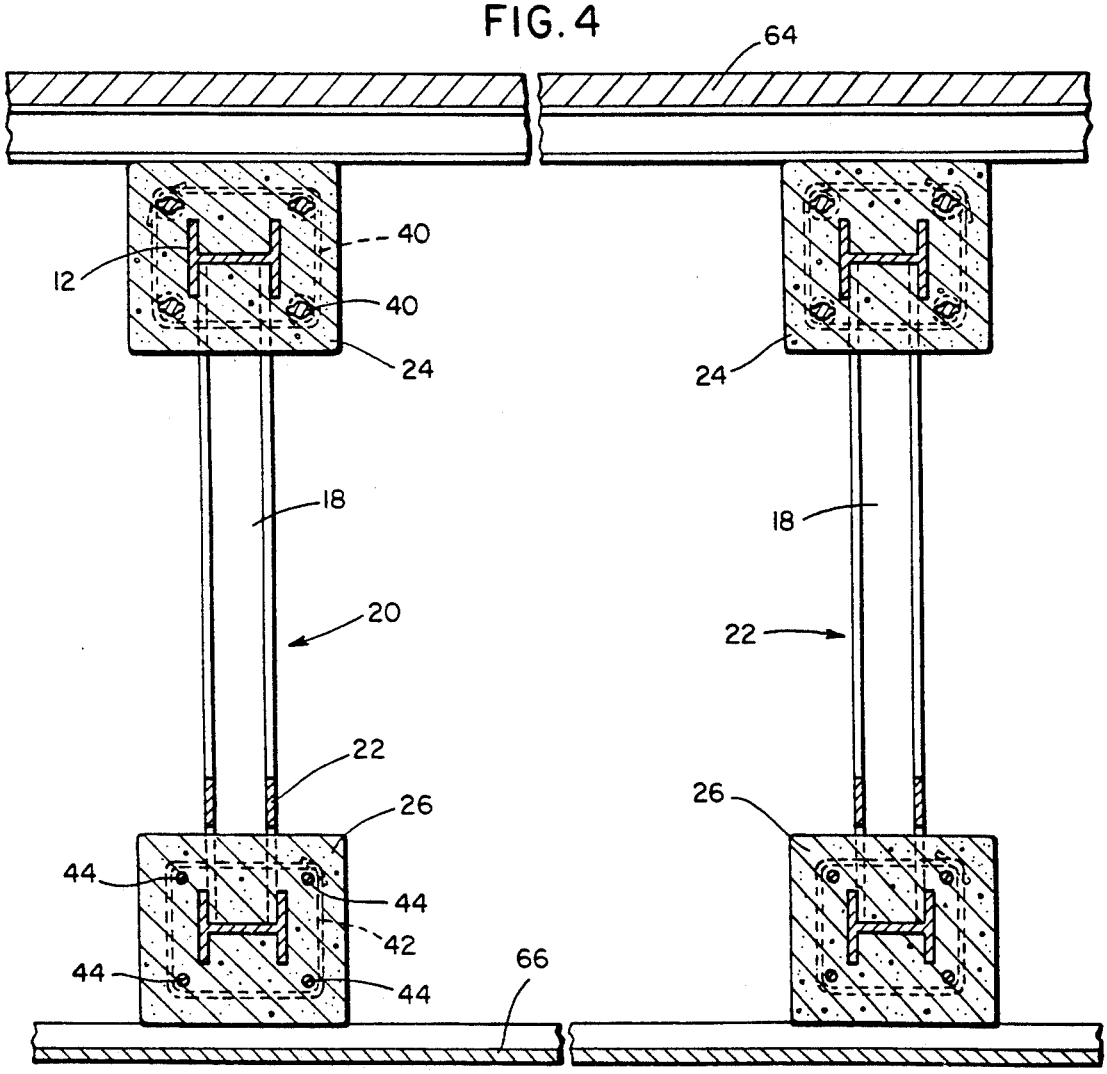
FIG. 4 is a transverse, sectional view, on an enlarged scale, taken substantially upon a plane passing along section line 4—4 on FIG. 2 illustrating the structure of the trusses including the reinforced concrete encasing the top and bottom chords with the top chord including reinforcing in the concrete and the bottom chord including reinforcing and steel tendons which are post-tensioned to provide maximum load supporting capability to the truss.

FIG. 4 illustrates the completed trusses 22 in which the top chord 12 is encased in concrete 24 and the concrete 24 is provided with steel reinforcement 40. The bottom chord 14 is encased in concrete 26 and is provided with reinforcement 42 and steel tendons 44 which are post-tensioned after the concrete 26 has hardened with conventional post-tensioning techniques being employed.

Figure 5:
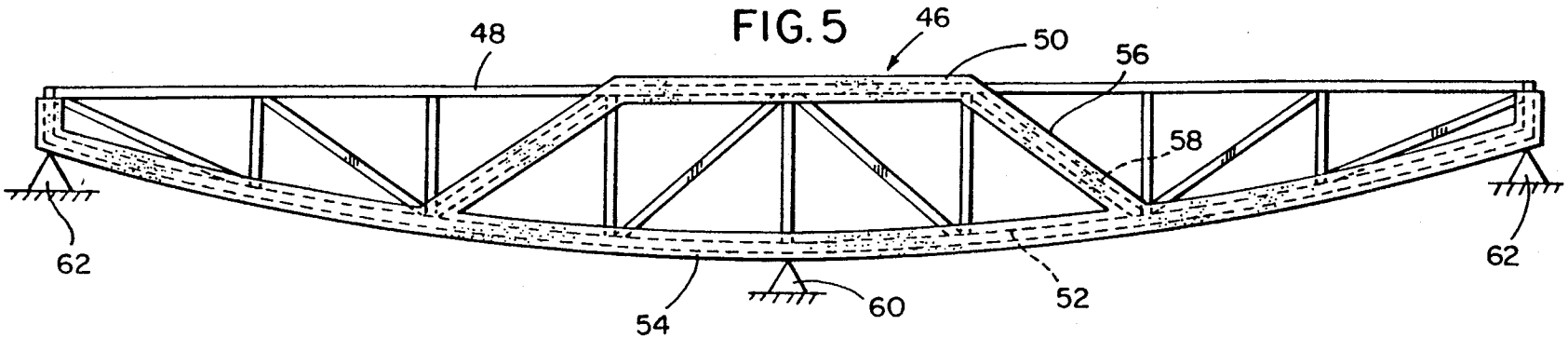
FIG. 5 is an elevational view similar to FIG. 2 but illustrating an arrangement in which the truss is a continuous truss provided with at least one support in the center and illustrating an arrangement in which the top chord is also provided with post-tensioned steel tendons since the intermediate support o supports for the continuous truss may introduce tension forces into the top chord.

FIG. 5 illustrates a truss 46 similar to the truss 22 except that in this case, only a portion of the top chord 48 is encased in concrete 50 with all of the lower chord 52 being encased in concrete 54. In this structure, the concrete 50 which encases a portion of the top chord 48 also extends diagonally downwardly at 56 and encases diagonally extending brace members 58. Also, as illustrated in FIG. 5, an intermediate support 60 is provided for the truss along with the end supports 62 which can introduce tension forces in the top chord due to the intermediate support or supports 60. Thus, in the concrete encasement in the top chord 48 and on the braces 58, steel tendons are encased in the same manner as illustrated in FIG. 4 with the steel tendons extending throughout the length of the concrete encasement 50 and 56 with the same tendons also extending to the ends of the concrete encasement 54 so that the steel tendons in the top chord encasement and the bottom chord encasement are all post-tensioned at the ends of the truss using conventional post-tensioning techniques. Another alternative is to encase only a portion of the top chord without any encasement of the brace rods in which event the steel tendons in the concrete encasement which does not extend all of the way to the ends of the top chord can be separately post-tensioned to increase the tensile strength of the top chord when a intermediate support or supports are used with the long span truss.

As described above, the light structural steel truss 10 is first erected to serve as a support for formwork to contain and support the concrete encasement when it is poured into the formwork to encase the top and bottom chords. The concrete encasement is reinforced and is used to accommodate post-tensioned steel tendons which, when stressed, add substantial strength to the truss as the steel tendons have an ultimate strength of 270,000 psi as compared ordinary structural steel that has ultimate yield strengths ranging from 36,000 to 50,000 psi. The post-tensioning of the steel tendons also reduces the sag that would result in a long span heavily loaded truss. The concrete encasing the bottom and top chords increase structural stiffness in the members and the top chord could also serve as the primary compression member of the truss. This truss construction will thus provide maximum and optimum load supporting capability at substantial cost savings which is accomplished by utilizing to advantage the structural steel properties of lightness in weight and ease in erection to conveniently provide an elevated formwork support to pour the reinforced concrete top and bottom chords. By using the lightweight steel truss to support the formwork, the need for temporary or permanent shoring is avoided thereby eliminating expensive construction techniques that also have the disadvantage of blocking traffic and obstructing the view which is especially important in building bridges, overpasses and other similar installations where traffic is involved.

Also, the use of the steel trusses to support the formwork enables the concrete to be pumped into place along the top and bottom chords of the steel truss thereby eliminating substantial cost in erecting heavy long span trusses. While the post-tensioning steel embedded in the bottom chord or optionally the top chord costs about twice the cost of structural steel, it will provide approximately five times the strength. With the concrete providing the stiffness and the fireproof encasement aspects required by the truss chords, the cost can be reduced as concrete is a relatively inexpensive material as compared to structural steel. However, high dead weight of concrete makes it difficult to precast and erect in long span trusses such as in high ceilings, over land traffic or over waterway traffic conditions.

As illustrated in FIG. 4, the trusses may be used to support, concrete slabs 64 and ceiling structures 66, metal decking and the like. The temporary scaffolding 30, 34 and 32 can be left in place to serve as a framing to hang the finished ceiling of the structure as well as to provide a platform support and access for personnel to perform installation of wiring, piping, lighting fixtures, maintenance, replacement, repairs and the like. As illustrated in FIG. 5, a continuous truss of two or more spans between the ends can effectively utilize concrete cladding and post-tensioning over the support areas in a drape fashion as shown in FIG. 5 or in a longitudinal fashion in which the concrete cladding does not extend along the diagonal bracing but the extent of the concrete cladding along a portion of the top chord is post-tensioned in the same manner. Thus, the concrete cladding on the top chord of the trusses could extend from end-to-end of the trusses or terminate short of the ends or extend downwardly of the braces with the post-tensioning taking place only where it is needed in the top chord. Also, the shape of the steel truss can be of different configurations from that shown and the same principle can be applied to multi-spans of 3, 4 or 5 spans with these variables being dependent upon the installation requirements involved.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A long span post-tensioned light steel/concrete truss encased in concrete comprising an elongated bottom chord, an elongated top chord spaced from the bottom chord, a plurality of vertical and diagonal braces interconnecting the top and bottom chords to form a rigid truss, said chords and braces being constructed of light structural steel and being completely assembled for support at end points, concrete cladding completely encasing said top and bottom chords and including steel reinforcement, said chords providing support for formwork for said concrete when poured, and a plurality of spaced, longitudinal steel tendons embedded in the concrete cladding encasing the bottom chord, said steel tendons being post-tensioned after the concrete has hardened to increase the strength of the bottom chord, and a plurality of spaced, longitudinal steel tendons embedded in the concrete cladding encasing the top chord of the truss and being post-tensioned to increase the strength of the top chord when the truss is supported at end points.

2. The truss as defined in claim 1 wherein said bottom chord is downwardly and arcuately curved to generally correspond with a bending moment diagram.

3. A long span post-tensioned light steel/concrete truss encased in concrete comprising an elongated bottom chord, an elongated top chord spaced from the bottom chord, a plurality of vertical and diagonal braces interconnecting the top and bottom chords to form a rigid truss, said chords and braces being constructed of light structural steel and being assembled for support at end points, concrete cladding encasing said top and bottom chords and including steel reinforcement, said chords providing support for formwork for said concrete when poured, and a plurality of spaced, longitudinal steel tendon embedded in the concrete cladding encasing the bottom chord, said steel tendons being post-tensioned after the concrete has hardened to increase the strength of the bottom chord, and a plurality of spaced, longitudinal steel tendons embedded in the concrete cladding encasing the top chord of the truss and being post-tensioned to increase the strength of the top chord when the truss is supported at end points, said concrete cladding encasing the top chord extending less than the full length of the top chord to increase the strength of the top chord in the area required by an intermediate support point.

4. The truss as defined in claim 3 wherein said concrete cladding on the top chord also extends along diagonal braces to merge and join with the cladding encasing the bottom chord, said steel tendons extending through the concrete cladding encasing the top chord and through the concrete cladding encasing the diagonal braces for post-tensioning to increase the strength of the truss.

5. The method of forming a long span truss consisting of the steps of completely assembling and erecting a lightweight steel truss, attaching scaffolding and bracing to the steel truss, supporting concrete forms solely from the scaffolding in associate with the top chord and bottom chord of the truss, positioning steel reinforcement in the forms, positioning a plurality of steel tendons longitudinally throughout the length of the bottom form associated with the bottom chord of the truss, positioning a plurality of steel tendons lengthwise in the form associated with the top chord of the truss pouring concrete in the forms to encase the top and bottom chords of the truss, steel reinforcement an steel tendons, allowing the concrete to harden and post-tensioning the steel tendons.

* * * * *

UNITED STATES PATENT AND TRADEMARK OFFICE

CERTIFICATE OF CORRECTION

PATENT NO. : 5,305,572
DATED : April 26, 1994
INVENTOR(S) : Alfred A. YEE

It is certified that error appears in the above-indentified patent and that said Letters Patent is hereby corrected as shown below:

In the Abstract, line 16, cancel "situation" and insert --situations--.

Column 1, line 41, cancel "a" and insert --as--;
line 65, cancel "spa" and insert --span--.

Column 2, line 27, cancel "conventions" and insert --convention--;
line 67, cancel "o" and insert --or--.

Column 4, line 17, after "compared" insert --to--;
line 22, cancel "increase" and insert --increases--;
line 30, after "concrete" insert --to encase the--.

Column 6, line 33, cancel "associate" and insert --association--;
line 39, after "truss" insert --,--;
line 41, cancel "an" and insert --and--.

Signed and Sealed this

Seventeenth Day of October, 1995

*Attest:*

*Attesting Officer*

BRUCE LEHMAN

*Commissioner of Patents and Trademarks*